US011326613B2

(12) United States Patent
De' Longhi et al.

(10) Patent No.: US 11,326,613 B2
(45) Date of Patent: May 10, 2022

(54) FAN FOR VENTILATING OR CONDITIONING ENVIRONMENT

(71) Applicant: DE' LONGHI APPLIANCES S.R.L. CON UNICO SOCIO, Treviso (IT)

(72) Inventors: Giuseppe De' Longhi, Treviso (IT); Maddalena Renier, Roncade (IT); Francesca Prosperi, Codognè (IT); Enrica Monticelli, Varese (IT); Raffaele Toffolo, Treviso (IT)

(73) Assignee: DE' LONGHI APPLIANCES S.R.L. CON UNICO SOCIO, Treviso (IT)

( * ) Notice: Subject to any disclaimer, the term of this patent is extended or adjusted under 35 U.S.C. 154(b) by 0 days.

(21) Appl. No.: 16/303,087

(22) PCT Filed: May 18, 2017

(86) PCT No.: PCT/EP2017/061965
§ 371 (c)(1),
(2) Date: Nov. 19, 2018

(87) PCT Pub. No.: WO2017/198765
PCT Pub. Date: Nov. 23, 2017

(65) Prior Publication Data

US 2019/0277297 A1 Sep. 12, 2019

(30) Foreign Application Priority Data

May 18, 2016 (IT) ..... 102016000051279
May 12, 2017 (IT) ..... 102017000051934

(51) Int. Cl.
*F04D 25/10* (2006.01)
*F04D 29/44* (2006.01)
(Continued)

(52) U.S. Cl.
CPC ..... *F04D 25/10* (2013.01); *F04D 25/08* (2013.01); *F04D 29/441* (2013.01); *F04D 29/541* (2013.01); *F05D 2250/52* (2013.01)

(58) Field of Classification Search
CPC ..... F04D 25/08; F04D 25/10; F04D 25/105; F04D 29/40; F04D 29/403; F04D 29/44;
(Continued)

(56) References Cited

U.S. PATENT DOCUMENTS 2,255,759 A * 9/1941 Carpenter ..... F24H 3/0411 392/376
2,471,784 A * 5/1949 Seifner ..... F24H 3/0411 237/2 R
(Continued)

FOREIGN PATENT DOCUMENTS

CN 104863871 A 8/2015
CN 105351230 A 2/2016
(Continued)

OTHER PUBLICATIONS

Li et al. Influence of Coanda surface curvature on performance of bladeless fan, Journal of Thermal Science vol. 23, No. 5 (2014) 422-431 (Year: 2014).*
(Continued)

*Primary Examiner* — David E Sosnowski
*Assistant Examiner* — Wayne A Lambert
(74) *Attorney, Agent, or Firm* — Marshall, Gerstein & Borun LLP

(57) ABSTRACT

A fan including a main body with a vertical development with respect to a support base on which the main body is located in a condition of use. The fan has a rear longitudinal aperture, for the emission of a stream of air toward the outside, and also comprises an air suction and distribution unit, and a channeling element (20) positioned in proximity
(Continued)

to the longitudinal aperture (16). The channeling element allows to divert the stream of air (W) so that it is conveyed toward a front part of the fan (10), at least partly following a profile (40) of an external surface (22) of the main body (12).

12 Claims, 2 Drawing Sheets

(51) Int. Cl.
*F04D 29/54* (2006.01)
*F04D 25/08* (2006.01)

(58) Field of Classification Search
CPC ..... F04D 29/441; F04D 29/54; F04D 29/541; F05D 2250/52; F05D 2250/14; F05D 2250/141; F05D 2250/16; F05D 2250/33; F05D 2250/62; F05D 2250/711; F05D 2250/712; F05D 2250/72; F05F 5/16
See application file for complete search history.

(56) References Cited

U.S. PATENT DOCUMENTS 2,583,374 A * 1/1952 Hoffman ..... F04D 25/14 454/344
3,047,208 A * 7/1962 Coanda ..... F02K 1/36 417/174
3,429,527 A * 2/1969 Whittley ..... B64C 29/0041 244/12.3
3,830,450 A * 8/1974 Williams ..... B64C 3/141 244/207
3,885,891 A * 5/1975 Throndson ..... F04F 5/16 417/196
4,332,529 A * 6/1982 Alperin ..... F02K 1/36 417/167
4,448,354 A * 5/1984 Reznick ..... B64C 29/00 239/265.17
4,466,819 A * 8/1984 Dunn ..... C03B 37/06 65/463
4,628,618 A * 12/1986 Virta ..... D21F 5/042 34/116
4,815,942 A * 3/1989 Alperin ..... F04F 5/467 417/163
4,856,968 A * 8/1989 Armbruster ..... F04D 25/08 417/360
5,762,034 A * 6/1998 Foss ..... F01P 5/06 123/41.49
6,073,881 A * 6/2000 Chen ..... B64C 39/001 244/12.2
8,992,174 B2 * 3/2015 Chang ..... F04F 5/16 415/206
2004/0120815 A1 * 6/2004 Lasko ..... F24H 9/1872 415/213.1
2010/0226752 A1 9/2010 Gammack et al.
2010/0226797 A1 * 9/2010 Fitton ..... F24F 1/01 417/313
2013/0111777 A1 * 5/2013 Jeong ..... A45D 20/12 34/97
2015/0136997 A1 5/2015 Kubo et al.

FOREIGN PATENT DOCUMENTS

FR 3065752 A1 * 11/2018 ..... F01P 5/02
JP 2015063979 A * 4/2015 ..... F04D 29/681
WO WO-2012/017220 A1 2/2012
WO WO-2012033517 A1 * 3/2012 ..... F04F 5/16

OTHER PUBLICATIONS

International Search Report and Written Opinion for PCT/EP2017/061960, dated Sep. 12, 2017.
International Search Report and Written Opinion for PCT/EP2017/061965, dated Jul. 24, 2017.

* cited by examiner

FAN FOR VENTILATING OR CONDITIONING ENVIRONMENT

FIELD OF THE INVENTION

The present invention concerns a fan usable in closed domestic or public places, to create a stream of air for ventilating or conditioning the surrounding environment.

The term fan as used hereafter is intended to mean, in a broader sense, any apparatus whatsoever able to supply ventilation, conditioning, cooling, heating, thermo-ventilation, dehumidification or purification of the air.

BACKGROUND OF THE INVENTION

Fans for rooms are known, substantially configured as a column, with a containing structure which houses the mechanical components that generate the stream of ventilation or conditioning air, and a zone from which the stream of air is emitted, comprising one or more exit apertures through which the stream is emitted toward the environment.

In the most typical and widespread solutions, the exit aperture is generally located in sight on the front part of the structure of the fan, often making the technical components partly visible, for example the ventilation blades and/or the possible heating means.

This can give the fan an unpleasant esthetic effect, preventing the manufacturer from obtaining a clean profile, without discontinuities and thus lowering the esthetic value of the fan.

Furthermore, since the technical components face directly toward the space, they are more subject to contact with dust or other dirt that can compromise the functioning thereof.

Portable fans are also known, which do not have the internal components visible or partly visible, or that do not have ventilation blades, but which have a stream of air confined to a limited portion of space.

In particular, the stream of air is greatly limited in its distribution in the space, which significantly reduces the effectiveness of the fan.

In the field of portable fans, moreover, there is a growing tendency to produce devices intended to confer a comfortable feeling for a user.

The concept of comfort is generally considered for installation products attached to or integrated in the walls of a room, but it is difficult to apply to ventilation products of the portable type.

For example, fans are known that provide to regulate the speed and temperature of the stream of air supplied by means of particular electronic controls, to keep them inside ranges such that they do not cause discomfort for the user. However, they do not guarantee either optimum performance of the fan or the desired level of comfort for the user.

The U.S. Pat. No. 6,997,680 for example describes the importance of the correct ventilation by a portable device for the heat comfort perceived by a user. The solution described provides to make a fan which comprises a combination of the characteristics of a column fan and a cooling tower, in which the stream of air is emitted from the inside of the fan directly toward the user.

The US patent application US 2004/0120815 describes a fan with a housing and an air generator, in which the air is introduced by an aperture provided in the lower zone of the housing, and is emitted through an exit aperture made in correspondence with a wall of the housing directly toward the user.

Other solutions of known fans intended to obtain a comfortable feeling for a user are described for example in U.S. Pat. No. 6,973,260 and in CN104807093.

These known solutions, due to their geometry and the disposition of the slit through which the air exits, are not able to optimize the conditioning of the zone occupied by the user, guaranteeing optimum heat wellness.

One purpose of the present invention is to obtain an improved fan compared with fans known in the state of the art.

Another purpose of the present invention is to obtain a fan which generates a distributed stream of air at uniform temperature, able to guarantee maximum comfort to the people in the room where it is positioned.

Another purpose is to obtain a fan that allows to condition in an optimum manner the zone where the user is positioned.

Another purpose of the present invention is to obtain a fan that allows to optimize consumption, thus achieving energy saving.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, the present invention concerns a fan to emit a stream of air into a space.

The fan comprises a main body with a vertical development with respect to a support base on which it is located in a condition of use, the main body defining an internal housing compartment.

According to one aspect of the present invention, the fan has a longitudinal aperture, for the emission of the stream of air toward the outside, and also comprises an air suction and distribution unit, and a channeling element positioned in proximity to the longitudinal aperture and cooperating with it to determine the exit of the stream of air through the longitudinal aperture, so that the exiting stream adheres to the external surface of the main body and is conveyed toward the front of the fan.

According to another aspect of the invention, the external surface of the main body has a rounded geometry substantially without discontinuities so that the stream of air, exiting from the longitudinal aperture, is conveyed adherent toward the environment to be ventilated or conditioned.

According to one aspect of the present invention, at least for the segment of the main body affected by the longitudinal aperture, the fan has a geometrical section shape of the external surface defined by a wing-like profile, suitable to confer on the stream of air that transits in contact with it values of temperature, speed and turbulence suitable to guarantee the user a feeling of optimum comfort.

In particular, the profile is defined by a polyline, which can be approximated by a plurality of convex arc segments located one after the other.

According to some embodiments, the convex arc segments that make up the polyline have a progressively increasing radius of curvature, and a progressively decreasing amplitude in the direction of the stream of air, that is, from the longitudinal aperture toward the front of the fan.

According to some embodiments, the profile of the characteristic section has a symmetrical shape with respect to the median plane of the fan, which joins the front part and the rear part where there is the longitudinal aperture.

The shape of the section defined by the polyline allows to keep the stream of air exiting from the longitudinal aperture adherent to the external wall of the main body toward the front part of the fan.

In particular, the shape of the section defined by the polyline allows to limit the formation of turbulence in the stream of air, something which can entail a great dissipation of energy and hence a poorer performance of the fan. In fact, when there is turbulence, the stream of air is able to reach smaller distances from the fan, compared with the distances that it could reach without turbulence.

Furthermore, the presence of turbulence can increase the heat exchange between the user and the surrounding environment, which can be unpleasant, especially if the fan is used for heating.

According to other embodiments, the main body, at least in correspondence with the zone defined by the polyline, also has a surface finish suitable to eliminate, or at least reduce, possible wrinkles and roughness.

According to another aspect, the channeling element has or is associated with means suitable to subdivide the stream of air exiting from the longitudinal aperture into two streams with opposite directions, so that the streams separate substantially in correspondence to the longitudinal aperture and are separately conveyed adhering to the external surface of the main body, toward the front part of the fan, where they are at least partly rejoined and spread into the environment.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
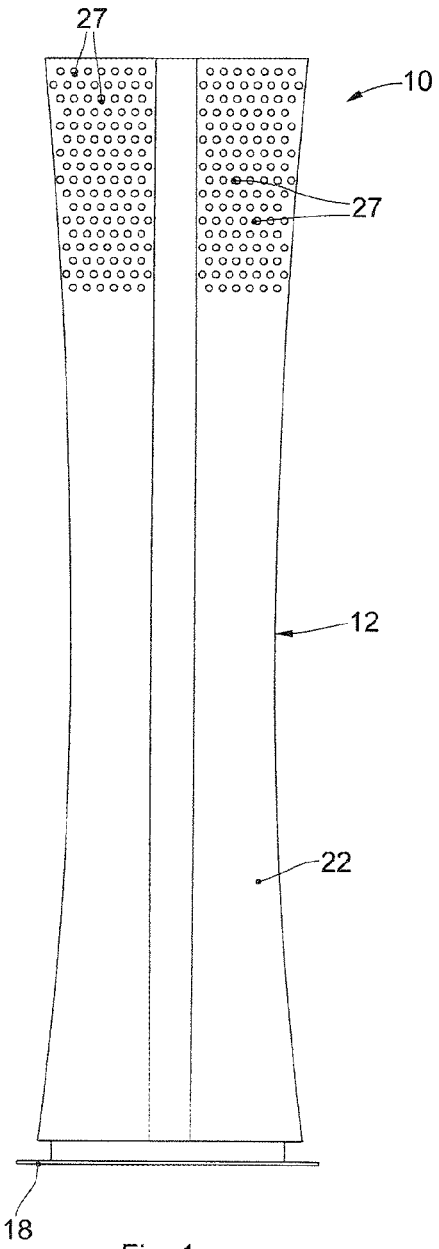
FIG. 1 is a front elevation view of a fan according to one embodiment of the present invention.

Embodiments described here with reference to FIGS. 1-4 concern a fan 10 usable in particular in closed spaces for ventilating air at room temperature, for cooling, heating, thermo-ventilating, dehumidifying or purifying air.

The fan 10 comprises a main body 12 with a vertical development with respect to a support base 18 on which it is positioned during use.

The main body 12 defines inside it a compartment 13 for housing functional components.

The fan 10 has a longitudinal aperture 16, and comprises a unit 14 to take in and distribute a stream of air W.

According to possible solutions, the air suction and distribution unit 14 is located, at least for a substantial part, above the longitudinal aperture 16.

The longitudinal aperture 16 is disposed on the opposite side with respect to the space to be conditioned. In particular, the longitudinal aperture 16 is located in the rear part of the fan 10, and the stream of air W exiting from the longitudinal aperture 16 is deflected so as to reach the front zone located at the front of the fan 10, as indicated by arrows F in FIGS. 3 and 4.

In general, the expressions "rear part" and "front zone" are only intended to define a functional relationship between these two parts, which have to be substantially opposite each other with respect to the main body 12 and the user.

According to other embodiments, the air suction and distribution unit 14 can comprise a rotor 15 provided with suitably oriented blades to determine the suction of the air from the outside and its entrance into the main body 12, and a drive member 17 connected to the rotor 15.

According to some embodiments, the suction and distribution unit 14 can be oriented in such a way that the axis of rotation of the rotor 15 is substantially parallel to the axis of development of the longitudinal aperture 16.

According to possible embodiments, the air enters inside the main body 12 through through entrance holes 27.

According to some embodiments, the through entrance holes 27 can be made at least partly above the longitudinal aperture 16, in the top part and/or on the upper lateral wall of the main body 12.

The fact that the through entrance holes 27 and the suction and distribution unit 14 are disposed in the upper part of the main body 12 advantageously allows to take in and recirculate cleaner air compared with that in correspondence with the floor, where dust or other dirt can deposit.

The compartment 13 allows to channel inside the fan 10 the stream of air W from the entrance holes 27 toward the longitudinal aperture 16.

The fan 10 also comprises a channeling element 20 positioned near the longitudinal aperture 16 and cooperating with it to direct the stream of air W toward the outside.

The channeling element 20 is configured so as to allow the stream of air W exiting from the longitudinal aperture 16 to adhere to an external surface 22 of the main body 12. In other words, the channeling element 20 is able to deflect the stream of air W exiting from the longitudinal aperture 16.

The channeling element 20 comprises an active surface 20*a* which, during use, is struck by the stream of air W exiting from the longitudinal aperture 16. The active surface 20*a* can have a convex shape.

The channeling element 20 makes the stream of air W exiting from the longitudinal aperture 16 in its travel toward the front zone of the fan 10 follow the profile of the external surface 22.

Furthermore, in cooperation with the external surface 22, the channeling element 20 is configured to determine a minimum passage section of the stream of air W exiting from the compartment 13.

In one formulation of the invention, the external surface 22 has a rounded geometry, substantially without any discontinuities, so that the stream of air, exiting from the rear part of the fan 10, is conveyed adherent toward the front part and then toward the space to be ventilated or conditioned.

According to one aspect of the present invention, the rounded geometry is suitable to convey the stream of air W adherent to the external surface 22 without creating significant variations in the development of the stream, and without creating disturbances, turbulence, discontinuities or any other factor that could disturb the development of the stream.

According to one embodiment, shown by way of example in FIG. 1, the main body 12 can have a tapered shape in at least part of its vertical development.

In particular, according to an advantageous formulation, the main body 12 has on its height a narrowing in section substantially in correspondence with the longitudinal aperture 16.

By way of example, the diameter inside which the cross section of the main body 12 is inscribed can be comprised in a range from 100 mm to 230 mm and the height of the main body 12 can be comprised in a range between 750 mm and 850 mm.

The main body 12 can be configured to have a continuous surface in the front part, while in correspondence with the longitudinal aperture 16 it has a profile folded toward the inside, to define the longitudinal aperture 16 itself.

In this way, the particular rounded geometry of the main body 12 in correspondence with the longitudinal aperture 16 allows to convey the stream of air W adherent to the external surface 22, so as to form a surface film that is then propagated toward the front of the fan 10.

According to one aspect of the invention, in correspondence with the zone affected by the longitudinal aperture 16, the main body 12 has a geometric section shape with a profile 40 defined by a polyline, which can be approximated by a plurality of convex arc segments S1, S2, S3, . . . SN located one after the other.

In particular, the polyline profile 40 is configured to generate a stream of air in the front part of the fan 10 such as to guarantee a high level of comfort for a user.

According to some embodiments, the profile 40 of the characteristic section has a symmetrical shape with respect to a median plane M of the fan 10 which joins the front part and rear part where there is the longitudinal aperture 16.

It should be noted that the profile 40 can affect only one zone of the main body 12, in particular that zone where the longitudinal aperture 16 is made.

In some embodiments, the longitudinal aperture 16 and the profile 40 can affect the whole longitudinal (vertical) development of the main body 12, or only one portion thereof.

According to some embodiments, in the direction of the stream of air from the longitudinal aperture 16 to the front part of the fan 10, the successive convex arc segments have a progressively decreasing amplitude and a progressively increasing radius of curvature.

According to some embodiments, the convex arc segments S1, S2, S3, . . . SN are tangent to each other.

Figure 3:
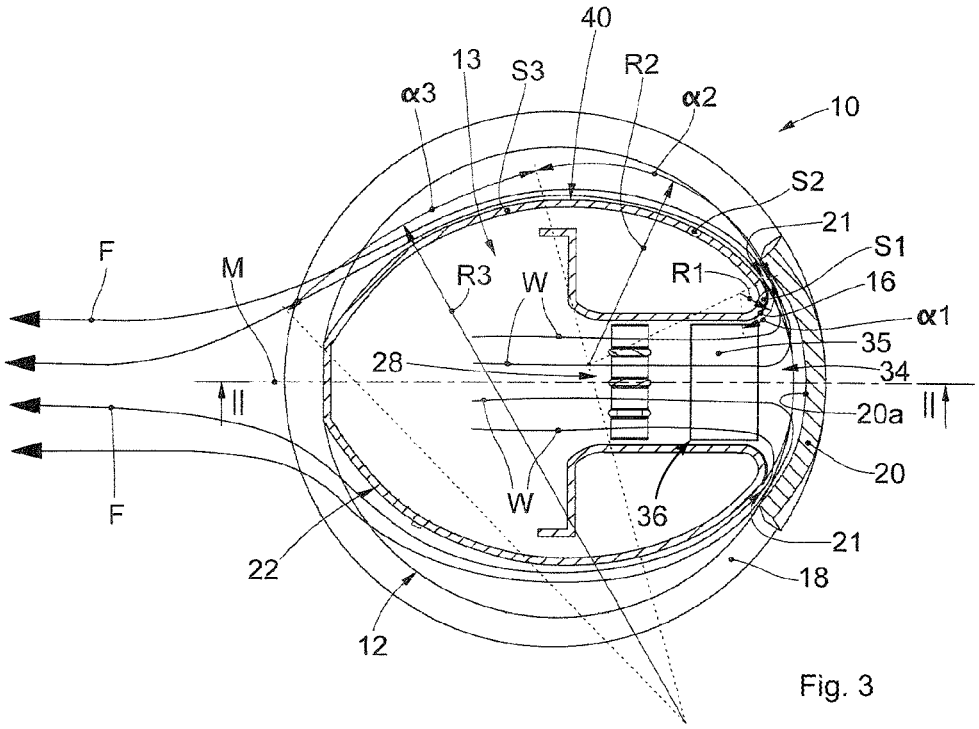
FIG. 3 is a cross section of the fan in FIG. 2.

According to some embodiments, for example shown with reference to FIG. 3, the profile 40 can be approximated by at least three convex arc segments S1, S2, S3.

Even if in the following description we refer by way of example to three arc segments, it is clear that there can be any number N of convex arc segments, for example five, seven, ten, twenty, one hundred or more, provided that the convex arc segments have a progressively decreasing amplitude with respect to each other in the direction of the stream of air, and a progressively increasing radius of curvature.

According to some embodiments, the first convex arc segment S1 can extend for an amplitude corresponding to a first angle $\alpha$1, comprised for example between 110° and 150°, and can have a first radius of curvature R1 comprised between 5 mm and 10 mm. In particular, the first radius of curvature R1 can be comprised between 6 mm and 8 mm. For example the first radius of curvature R1 can be comprised between 6.8 mm and 7.2 mm.

According to other embodiments, the first convex arc segment S1 can extend for an amplitude corresponding to a first angle $\alpha$1, comprised between 120° and 140°, and can have a first radius of curvature R1 which can be comprised for example between 6.9 mm and 7.1 mm.

According to other embodiments, the second convex arc segment S2 can extend for an amplitude corresponding to a second angle $\alpha$2, comprised for example between 50° and 70°, and can have a second radius of curvature R2 comprised between 25 mm and 45 mm. In particular, the second radius of curvature R2 can be comprised between 30 mm and 40 mm.

According to other embodiments, the second convex arc segment S2 can extend for an amplitude corresponding to a second angle $\alpha$2, comprised between 55° and 65°, and can have a second radius of curvature R2 comprised between 32 mm and 37 mm.

According to some embodiments, the third convex arc segment S3 can extend for an amplitude corresponding to a third angle $\alpha$3, comprised for example between 20° and 40°, and can have a third radius of curvature R3 comprised between 80 mm and 130 mm. In particular, the third radius of curvature R3 can be comprised between 90 mm and 120 mm.

According to other embodiments, the third convex arc segment S3 can extend for an amplitude corresponding to a third angle $\alpha$3, comprised between 25° and 35°, and can have a third radius of curvature R3 comprised between 100 mm and 110 mm, more particularly it can be comprised for example between 104 mm and 106 mm.

According to some embodiments, the second convex arc segment S2 is tangent at one end with the first convex arc segment S1 and at the opposite end with the third convex arc segment S3, so that the profile 40 has a development without discontinuities.

According to other embodiments, it can be provided that each convex arc segment S1, S2, S3 itself consists of a plurality of arc sub-segments, which in their entirety approximate the respective arc segments S1, S2, S3. Each arc sub-segment has, with respect to the previous segment (in the direction of the stream of air W) a progressively decreasing amplitude and a progressively increasing radius of curvature.

For example, according to a possible embodiment, not shown, it can be provided that instead of the first convex arc segment S1, two arc sub-segments are disposed one after the other, and extend for respective amplitudes, for example with angles of 67° and 63°, and in which the respective radii of curvature can vary for example from 6.8 mm to 7 mm and from 7 mm to 7.2 mm.

According to other embodiments, the curvature of the first convex arc segment S1 cooperates with the channeling element 20 to define an exit passage 21 for the stream of air.

According to other embodiments, the channeling element 20 can have an arched shape, with a radius of curvature suitable to cooperate with the first arc segments to define an exit passage 21 on each side of the median plane M.

According to some embodiments, the channeling element 20 can have a curvilinear profile, which can be positioned above the portion of the external surface 22 in correspondence with the longitudinal aperture 16.

In one embodiment, the channeling element 20 has a longitudinal development at least equal to the extension of the longitudinal aperture 16.

Figure 2:
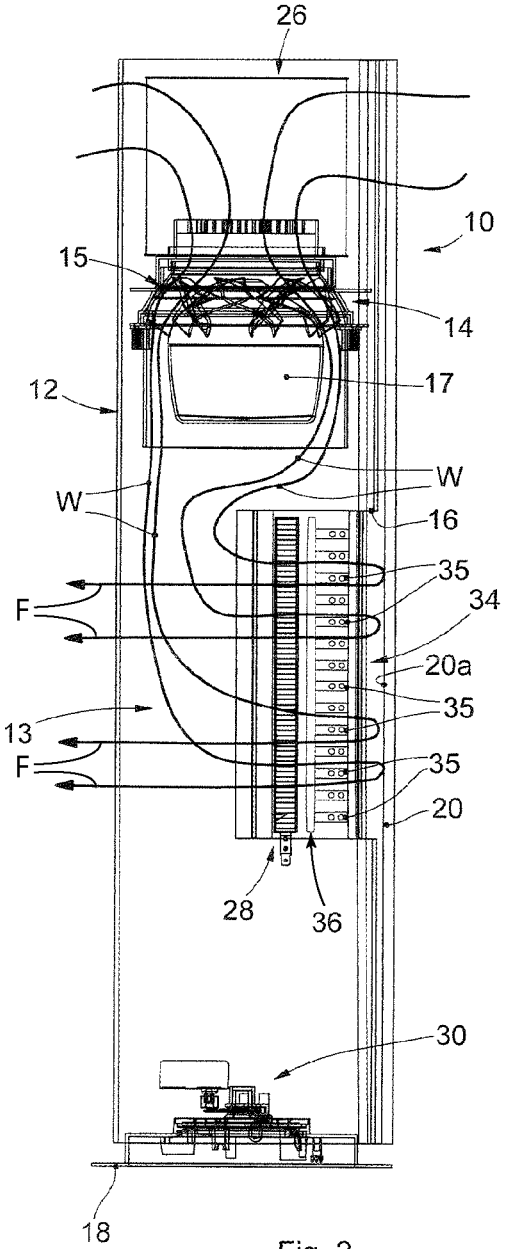
FIG. 2 is a view in section of the fan in FIG. 1 taken according to the section plan II-II visible in FIG. 3.

In another embodiment, shown in FIG. 2, the channeling element 20 has a vertical development equal to the development of the main body 12.

Figure 4:
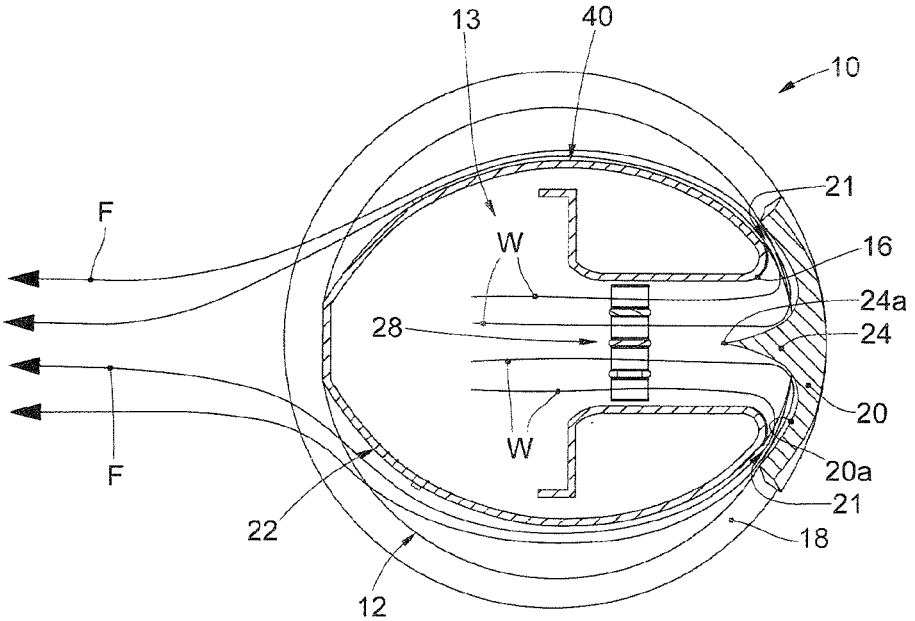
FIG. 4 is a cross section of a variant of the fan in FIG. 2.

In another embodiment, shown by way of example in FIG. 4, the channeling element 20 can provide a separator element 24 configured to determine a separation substantially into two halves of the stream of air W exiting from the longitudinal aperture 16.

According to some embodiments, the separator element 24 can have in section a triangle or arrow shape, with an apex 24*a* facing toward the longitudinal aperture 16 and the base facing toward the channeling element 20.

According to other embodiments, the separator element 24 can have concave sides, arched toward the inside.

In some embodiments, the apex 24*a* can be rounded or beveled.

The presence of the separator element 24 allows to obtain a progressive reduction in the transit section of the air, which is maximum in correspondence with the longitudinal aperture 16, that is, on the apex 24*a* of the separator element 24, and is minimum in correspondence with the end of the exit passage 21, that is, in correspondence with the outermost end of the channeling element 20.

The reduction in section between the apex 24*a* of the separator element 24 and the passage 21 can therefore determine an increase in the speed of the stream of air W toward the outside and toward the front part of the fan 10.

In this way two streams of air W are created, with opposite directions, each of which, exiting from a respective passage 21, adheres with a respective portion of the external surface 22 of the main body 12, with the streams substantially combining again on the front of the fan 10.

According to some embodiments, the passage 21 is conformed as a narrowing in section for the passage of the stream of air W.

According to some embodiments, each passage 21 has a width comprised between about 0.1 mm and 50 mm.

According to some embodiments, the passage 21 has a width comprised between about 1 mm and about 20 mm.

According to other embodiments, the passage 21 has a width comprised between about 3 mm and about 10 mm.

The width of the passage 21 thus designed allows to supply a stream of air toward the user with a speed suitable to confer on the user a sensation of optimum comfort at the desired distance.

In particular, the speed of the stream of air at exit is such as to optimize both the effectiveness of the functioning of the fan 10 and the comfort of the user.

In particular, thanks to the fact that in correspondence with the longitudinal aperture 16 a wing-shaped profile 40 is formed, the stream of air W is kept adherent to the external surface 22 for a greater segment than it would be if the section were circular and constant for the whole height of the main body 12. Consequently, the stream of air W that strikes the user will be more intense and less turbulent.

For example, according to some embodiments, the stream of air W obtained with the fan 10 according to the invention, at a distance comprised between about 50 cm and about 300 cm from the fan 10, has a front that develops substantially uniform in a longitudinal direction, such as to optimize a feeling of heat wellbeing in the user. More particularly, the distance can be comprised between 150 cm and 300 cm.

According to other embodiments, the external surface 22 of the main body 12, at least in correspondence with the sections defined by the polyline profile 40, has a surface finish suitable to eliminate, or at least reduce, possible wrinkles and roughness, so as to prevent turbulence in the stream of air, thus guaranteeing a high level of comfort for the user.

According to some embodiments, the external surface 22 can have a surface roughness comprised between 0.001μ and 100μ measured in terms of Ra, Rz and Rq.

According to other embodiments, the external surface 22 can have a surface roughness comprised between 0.01μ and 50μ.

The combination of the geometric shape of the profile 40, the width of the passage 21 and the surface roughness as described above determines optimum comfort for the user, since the speed, temperature and turbulence of the stream of air generated are such as to guarantee a homogeneous stream on the horizontal plane, which can surround the user without creating hotter or colder points in localized parts of the body.

For example, considering three characteristic heights for a person seated and standing, and considering a room temperature T of not more than 21° C. for heating and not less than 24° C. for cooling, the geometric parameters given above allow to obtain a stream of air with the following characteristics of speed, temperature and turbulence.

For example, in the case of heating, the speed at a height corresponding to the heels of a user is a non-zero value and can be, for example, less than about 0.6 m/s, while the maximum speed of the stream of air at a distance of about 50 cm from the fan 10 can be less than 2 m/s, so as to prevent localized cooling effects.

In the case of cooling, the speed at a height corresponding to the heels of a user can be more than 0.1 m/s, and in any case for every longitudinal section not less than 0.05 m/s.

According to some embodiments, the temperature of the stream of air in heating mode can be higher than room temperature for all the sections characterized by the shape of the profile 40, while in cooling mode the temperature can be the same as the room temperature.

Finally, with regard to turbulence, this can be eliminated or at least significantly reduced compared with that in known apparatuses. For example, with the profile 40 according to the invention the turbulence of the stream of air W will always be less than 50% and, in particular, in the sections where the stream of air has maximum speed, the turbulence will be less than 20%.

In this way, for each section characterized by a profile 40, a homogeneous front of the stream of air is created, with a longitudinal development, characterized by small vertical gradients, which is able to generate a feeling of heat wellbeing in the user.

According to some embodiments, for example, the maximum speed gradients in the case of heating and cooling can be, respectively, less than 1 m/s, or comprised between 1 m/s and 3 m/s.

According to other embodiments, the maximum temperature gradients can be, in the case of heating, less than 3° C. on the horizontal axis, and less than 3° C. on the vertical axis.

According to other embodiments, the maximum gradients of turbulence in the case of heating and cooling can be kept respectively less than 30% and less than 40%.

According to some embodiments, the fan 10 according to the invention allows to condition the zone where the user is in the best possible way. In particular, the profile 40 allows to supply a homogeneous stream of air that tends to improve the user's perception of the heat, without needing to condition the whole room, thus allowing to obtain great energy saving.

Indeed, the energy consumption needed to create a zone of heat wellbeing surrounding a user is less than the energy consumption that would be needed to guarantee the same heat wellbeing by conditioning the whole room.

According to other embodiments, shown by way of example in FIG. 2, the fan 10 can also comprise a filtering element 26, installed upstream of the air suction and distribution unit 14 and in correspondence with the entrance holes 27, so that the air sucked in can be suitably cleaned and purified of dust or particular allergens present in it.

According to another embodiment, shown by way of example in FIG. 2, the fan 10 can comprise a conditioning device 28 installed inside the main body 12 and in substantial correspondence with the longitudinal aperture 16.

The conditioning device 28 can be any device whatsoever, able to modify the condition of the stream of air W to supply a determinate effect inside the space where it is emitted by the fan 10.

For example, the conditioning device 28 can supply heating, cooling or dehumidification of the stream of air W, or also a combination of these in the case of a fan 10 designed to perform diverse functions according to requirements.

According to embodiments described here, the fan 10 comprises a deflector device 34 provided with a plurality of deflector elements 35 to convey the stream of air through the longitudinal aperture 16 and toward the channeling element 20.

According to another embodiment, shown by way of example in FIGS. 2 and 3, the fan 10 can comprise an adjustment device 36 which cooperates with the deflector device 34 to determine the desired orientation of the deflector elements 35, in order to modulate the direction of the stream of air W.

In one embodiment, the adjustment device 36 can determine the rotation of the deflector elements 35 from a position substantially parallel to the support base 18 to a position substantially perpendicular to the support base 18.

According to another embodiment, shown by way of example in FIG. 2, the fan 10 also comprises a device 30 to rotate the main body 12, so that it is possible to direct the jet of air as a function of the position of the user.

It is clear that modifications and/or additions of parts may be made to the fan 10 as described heretofore, without departing from the field and scope of the present invention.

It is also clear that, although the present invention has been described with reference to some specific examples, a person of skill in the art shall certainly be able to achieve many other equivalent forms of fan, having the characteristics as set forth in the claims and hence all coming within the field of protection defined thereby.

The invetion claimed is:

1. A fan comprising:

a main body with a vertical development with respect to a support base on which the main body is located in a condition of use, said main body defining only one internal housing compartment having only one rear longitudinal aperture for the emission of an exiting stream of air directed outwardly from the internal housing compartment and through the longitudinal aperture;

an air suction and distribution unit located completely above a beginning of the rear longitudinal aperture; and a channeling element positioned in proximity to said longitudinal aperture and cooperating with the longitudinal aperture to divert said exiting stream of air so that said exiting stream of air is conveyed toward a front part of the fan by at least partly following a profile of an external surface of the main body, wherein said profile comprises a polyline profile formed at least in part by a plurality of convex arc segments located one after the other, said polyline profile being configured to generate a stream of air toward the front part of the fan;

wherein said external surface of said main body has a continuously rounded geometry so that the exiting stream of air is conveyed adherent toward the front part of the fan and then toward an external environment to be ventilated or conditioned; and wherein said profile has a symmetrical shape with respect to a median plane of the fan, the median plane extending between the front part of the fan and a rear part of the fan where said longitudinal aperture is located; and wherein the channeling element is configured to cooperate with the external surface of the main body to determine a minimum passage section of the exiting stream of air exiting from the internal housing compartment and is arranged to divide the exiting stream of air as the exiting stream of air flows rearwardly and parallel to the median plane through the minimum passage section into two streams of air directed towards the front part of the fan opposite relative to the median plane.

2. The fan as in claim 1, wherein said convex arc segments that form said polyline profile have a progressively increasing radius of curvature, and a progressively decreasing amplitude in direction of the exiting stream of air, that is, from the longitudinal aperture toward the front part of the fan.

3. The fan as in claim 1, wherein said convex arc segments are in pairs tangent to each other.

4. The fan as in claim 1, wherein said profile is approximated by at least three convex arc segments, wherein a first convex arc segment extends for an amplitude corresponding to a first angle comprised between 110° and 150° , with a first radius of curvature comprised between 5 mm and 10 mm, a second convex arc segment extends for an amplitude corresponding to a second angle comprised between 50° and 70°, with a second radius of curvature comprised between 25 mm and 45 mm, and wherein a third convex arc segment extends for an amplitude corresponding to a third angle comprised between 25° and 35°, with a third radius of curvature comprised between 80 mm and 130 mm.

5. The fan as in claim 1, wherein said channeling element has a curvilinear profile which overlaps a portion of said external surface of the main body that is disposed adjacent to said longitudinal aperture.

6. The fan as in claim 1, wherein said channeling element, in cooperation with said external surface, is configured to determine a minimum section for a passage of said exiting stream of air.

7. The fan as in claim 6, wherein said passage has a width comprised between about 0.1 mm and 50 mm.

8. The fan as in claim 1, wherein said external surface, at least in correspondence with the convex arc segments defined by said polyline profile have a surface roughness comprised between 0.001 μ and 100 μ measured in terms of Ra, Rz and Rq.

9. The fan as in claim 1, wherein, for each of the plurality of convex arc segments forming said polyline profile, said stream of air has a homogeneous front with a longitudinal development, wherein said stream of air, at a distance comprised between about 50 cm and about 300 cm from the fan, has defined and uniform values of temperature, speed and turbulence, with small gradients and deviations from a mean value.

10. The fan as in claim 1, wherein said channeling element comprises a separator element configured to determine a separation of the exiting stream of air into two portions.

11. The fan as in claim 10, wherein said separator element has in section a triangle or arrow shape, with an apex facing toward said longitudinal aperture and a base facing toward said channeling element, said triangle or arrow shaped section determining a progressive reduction in a transit section of the air from said apex of said separator element toward an exit passage.

12. The fan as in claim 1, comprising a filtering element located upstream of said suction and distribution unit and in correspondence with entrance holes.

* * * * *